US011260279B2

(12) United States Patent
Kietzke et al.

(10) Patent No.: US 11,260,279 B2
(45) Date of Patent: Mar. 1, 2022

(54) BASEBALL TRAINING DEVICE

(71) Applicants: Rich Kietzke, Campbell, CA (US); Michael J. Randazzo, Campbell, CA (US)

(72) Inventors: Rich Kietzke, Campbell, CA (US); Michael J. Randazzo, Campbell, CA (US)

( * ) Notice: Subject to any disclaimer, the term of this patent is extended or adjusted under 35 U.S.C. 154(b) by 0 days.

(21) Appl. No.: 16/402,026

(22) Filed: May 2, 2019

(65) Prior Publication Data

US 2019/0336838 A1 Nov. 7, 2019

Related U.S. Application Data

(60) Provisional application No. 62/665,607, filed on May 2, 2018.

(51) Int. Cl.
*A63B 67/20* (2006.01)
*A63B 69/00* (2006.01)

(52) U.S. Cl.
CPC ..... *A63B 69/0002* (2013.01); *A63B 69/0086* (2013.01); *A63B 2069/0006* (2013.01)

(58) Field of Classification Search
CPC ..... A63B 69/0002; A63B 69/0086; A63B 2069/0006; A63B 21/0004; A63B 21/0061
USPC ..... 473/422–426, 450, 458, 464, 575, 576; 482/122; D21/780, 707, 713, 719, 723, D21/787–789, 698
See application file for complete search history.

(56) References Cited

U.S. PATENT DOCUMENTS 667,563 A * 2/1901 Oakley ..... A63B 69/0088 473/424
1,826,221 A * 10/1931 Pearson ..... A63B 43/02 473/575
2,224,103 A * 12/1940 Nilson ..... A63B 21/00185 482/124
3,140,871 A * 7/1964 Liquori ..... A63B 5/22 482/81
3,214,166 A * 10/1965 Gaudet ..... A63B 69/0088 473/424
4,852,874 A * 8/1989 Sleichter, III ..... A63B 21/0004 482/122
4,867,451 A * 9/1989 Mitchell ..... A63B 43/02 473/576
5,230,682 A * 7/1993 Myers ..... A63B 21/0004 473/576
5,282,777 A * 2/1994 Myers ..... A63B 21/0004 473/576
8,876,636 B2 * 11/2014 Rubel ..... A63B 67/22 473/425
9,114,298 B2 * 8/2015 Ruggiero ..... A63B 69/206 482/83
D746,394 S * 12/2015 Fujisaki ..... D21/466
D822,136 S * 7/2018 Vincson, Jr. ..... D21/780
10,279,236 B1 5/2019 McCaleb
D864,329 S * 10/2019 Neahr ..... D21/780
2007/0155544 A1 * 7/2007 Killion ..... A63B 69/0086 473/424

(Continued)

*Primary Examiner* — Mitra Aryanpour
(74) *Attorney, Agent, or Firm* — Haverstock & Owens, A Law Corporation

(57) ABSTRACT

A baseball training device comprises a contact segment in the shape of a flexible loop coupled to a first side of an object and a securing mechanism coupled to a second side of the object for securing the baseball training device to a wrist of a user.

11 Claims, 5 Drawing Sheets

(56) References Cited

U.S. PATENT DOCUMENTS

| | | | | |
|---|---|---|---|---|
| 2012/0208657 | A1* | 8/2012 | Simpson | A63B 69/0079<br>473/424 |
| 2013/0320050 | A1* | 12/2013 | Elliott | A63B 69/0084<br>223/66 |
| 2019/0336838 | A1* | 11/2019 | Kietzke | A63B 69/0086<br>473/425 |

* cited by examiner

BASEBALL TRAINING DEVICE

RELATED APPLICATIONS

This patent application claims priority under 35 U.S.C. 119(e) of the U.S. provisional patent application, Application No. 62/665,607, filed on May 2, 2018, and entitled "BASEBALL TRAINING DEVICE," which is also hereby incorporated by reference in its entirety.

FIELD OF THE INVENTION

The present invention is generally directed to baseball training systems and devices. More particularly, the present invention is directed to a baseball training device for practicing the baseball pitching motion.

BACKGROUND OF THE INVENTION

Certain drills and exercises enable a baseball player to practice proper form, timing and mechanics that are necessary throughout the course of a baseball game. Pitching drills can be especially effective when practiced without throwing an actual baseball to rest and/or not further stress a pitcher's arm. It is important that such drills are performed properly so that the pitcher and/or player is not inadvertently injured while performing the drills.

SUMMARY OF THE INVENTION

A baseball training device comprises a contact segment in the shape of a flexible loop coupled to a first side of an object and a securing mechanism coupled to a second side of the object for securing the baseball training device to a wrist of a user. In some embodiments, a hand support couples to one or more flexible tubes and supports the one or more flexible tubes as the stem of the device is grasped by a user while the baseball training device is used to simulate the baseball pitching motion. In some embodiments, the training device comprises a first contact segment comprising a first loop and a second segment comprising a second loop for adjustably fitting around a wrist of a user. A spherical object between the first segment and the second segment is grasped while the baseball training system is used to simulate the baseball pitching motion.

In one aspect, a baseball training system comprises a first contact segment comprising a first loop, a second segment comprising a second loop for adjustably fitting around a wrist of a user and a spherical object coupled to the device between the first segment and the second segment, wherein the first segment and the second segment are pulled through an aperture of the object to adjust a size of the second loop to the wrist of the user. In some embodiments, the spherical object comprises a diameter of 2.75". In some embodiments, the second segment comprises a joiner for joining two ends of the second segment. In some embodiments, the system comprises a sleeve that passes through the aperture of the spherical object to aid in pulling the first segment and the second segment through the aperture of the object to adjust the size of the second segment to the wrist of the user. In further embodiments, the system comprises a stop for preventing the first segment and the second segment being pulled entirely through the aperture of the object. In some embodiments, the spherical object comprises the size and shape of a baseball. In some embodiments, the baseball training system is used to practice a pitching motion.

In another aspect, a baseball training device comprises a first contact segment comprising a first flexible loop, a second segment for adjustably fitting around a wrist of a user and a spherical object coupled between the first segment and the second segment, wherein the second segment is adjustable to fit around a wrist of a user and the spherical object is grasped while the baseball training system is used to simulate the baseball pitching motion. In some embodiments, the spherical object comprises a diameter of 2.75". In some embodiments, the second segment comprises a joiner for joining two ends of the second segment. In some embodiments, the first segment and the second segment are pulled through an aperture of the object to adjust a size of the second segment to the wrist of the user. In further embodiments, the device comprises a sleeve that passes through the aperture of the spherical object to aid in pulling the first segment and the second segment through the aperture of the object to adjust the size of the second loop to the wrist of the user. In some embodiments, the device comprises a stop for preventing the first segment and the second segment being pulled entirely through the aperture of the object. In further embodiments, the second segment comprises a hook and loop material for adjusting a size of the second segment to the wrist of the user. In some embodiments, the spherical object comprises the size and shape of a baseball. In some embodiments, the baseball training device is used to practice a pitching motion.

In a further aspect, a method of manufacturing a baseball training device comprises forming a large loop comprising a flexible material, passing the large loop through an aperture of a spherical object such that a first contact segment comprising a first loop and a second segment comprising a second loop for adjustably fitting around a wrist of a user are formed and adjusting the second loop to the wrist size of the user by pulling on one of the first loop and the second loop. In some embodiments, the first segment and the second segment are pulled through an aperture of the object to adjust a size of the second segment to the wrist of the user. In further embodiments, the second segment comprises a hook and loop material for adjusting a size of the second segment to the wrist of the user. In some embodiments, the spherical object comprises the size and shape of a baseball. In some embodiments, the baseball training system is used to practice a pitching motion.

BRIEF DESCRIPTION OF THE DRAWINGS

Several example embodiments are described with reference to the drawings, wherein like components are provided with like reference numerals. The example embodiments are intended to illustrate, but not to limit, the invention. The drawings include the following figures.

DETAILED DESCRIPTION OF THE EMBODIMENTS

Embodiments of the invention are directed to a baseball training device comprising a contact segment in the shape of a flexible loop coupled to a first side of an object and a securing mechanism coupled to a second side of the object. In some embodiments, a hand support couples to one or more flexible tubes and supports the one or more flexible tubes as the stem of the device is grasped by a user while the baseball training device is used to simulate the baseball pitching motion. In some embodiments, the training device comprises a first contact segment comprising a first loop and a second segment comprising a second loop for adjustably fitting around a wrist of a user. A spherical object between the first segment and the second segment is grasped while the baseball training system is used to simulate the baseball pitching motion.

Reference will now be made in detail to implementations of a baseball training device. In the interest of clarity, not all of the routine features of the implementations described herein are shown and described. It will be appreciated that in the development of any such actual implementation, numerous implementation-specific decisions can be made in order to achieve the developer's specific goals, such as compliance with application and business related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

For baseball players, the towel drill enables a pitcher to practice the pitching motion without throwing an actual baseball. The most common version of the towel drill involves performing the pitching motion holding a towel in the throwing hand with the intention of hitting a target in front of the pitcher's landing foot. The idea is to consistently hit the target, the pitcher must demonstrate good extension, balance, and posture. Additionally, the towel drill provides feedback as any miscue during the pitching motion causes the pitcher to miss the target. The baseball training device implements this drill by utilizing one or more flexible tubes which are able to be grasped by a user to practice the baseball pitching motion.

Figure 1:
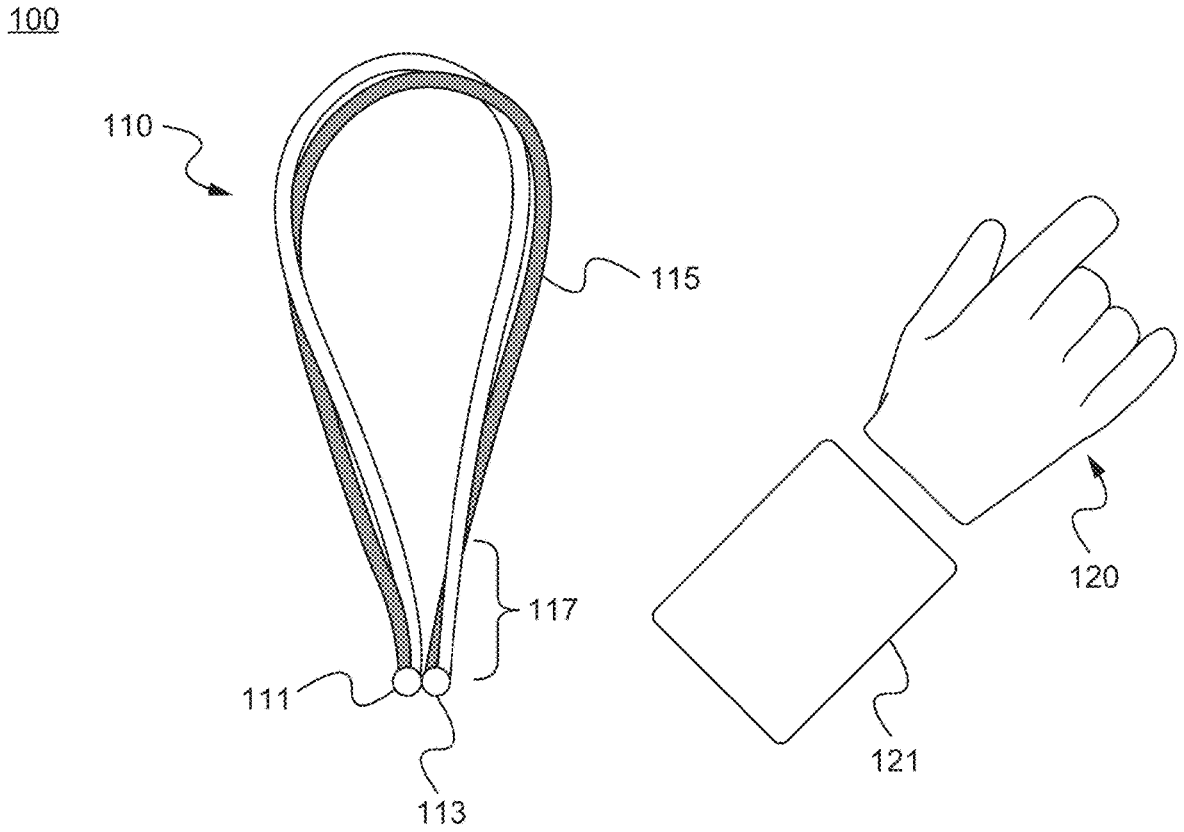
FIG. 1 illustrates a baseball training device in accordance with some embodiments.

Referring now to FIG. 1, a baseball training device is depicted therein. The device 100 comprises one or more flexible tubes 110 comprising a flexible loop 115, a grasping segment 117 coupled to the flexible loop 115 that is grasped by a user and a hand support 121, which couples to the contact segment 110 and the grasping segment 117 and supports the device 100 while the device 100 is used to stimulate the baseball pitching motion. In some embodiments, the hand support 121 is configured to wrap around a wrist and a thumb of the user of the user to cover the grasping segment 117 and support the one or more flexible tubes 110 comprising a flexible loop 115 as the device is used. Alternatively, in some embodiments, the hand support 121 is configured to wrap around a wrist of the user to cover the grasping segment 117 and support the one or more flexible tubes 110 comprising a flexible loop 115 as the device is used.

As shown within FIG. 1, a plurality of flexible tubes 110 are arranged to form the loop 115. The plurality of flexible tubes comprise a first end 111 and a second end 113 and the plurality of flexible tubes are arranged such that the first end 111 and the second end 113 are aligned. With the first end 111 and the second end 113 aligned, the plurality of flexible tubes are able to form a grasping segment 117 or stem. In some embodiments, the grasping segment 117 or the stem is held in the hand of a user when the user practices the baseball pitching motion. Particularly, in some embodiments, the grasping segment 117 or the stem is able to be held between an index finger and a middle finger of the user when the user practices the baseball pitching motion.

As further shown within FIG. 1, in some embodiments, the hand support 121 comprises a strap and/or other apparatus which is able to secure the flexible loop 115 and the grasping segment 117 to a hand and/or a wrist of the user. Particularly, as described above, in some embodiments, the hand support 121 is configured to wrap around a wrist and thumb of the user to secure the device 100 as it is used to stimulate the baseball pitching motion. Alternatively, in some embodiments, the hand support 121 is configured to wrap around a wrist of the user to secure the device 100 as it is used to stimulate the baseball pitching motion. In some embodiments, the hand support 121 is configured to reflect the approximate size and weight of a baseball. In some embodiments, the hand support 121 enables a user to secure the grasping segment between the index finger and the middle finger of the user when the user practices the baseball pitching motion, such as described above. In some embodiments, the hand support 121 is configured to removably couple to with the contact segment 110 and the grasping segment 117 or the stem. In further embodiments, such as shown in FIG. 1, a glove 120 is able to be used to secure the device 100 as it is used to stimulate the baseball pitching motion.

In some embodiments, the hand support 121 non-removably couples with the one or more flexible tubes 110 and the grasping segment 117 or the stem. Additionally, although as shown within FIG. 1, the hand support 121 comprises a strap, the hand support 121 is able to comprise any appropriately desired support capable of supporting the one or more flexible tubes 110 and the grasping segment 117 or the stem. For example, in some embodiments, the hand support 121 comprises a wrist guard. The hand support 121 ensures that the system does not fall from the user's hand while the user is practicing the pitching motion.

Figure 2:
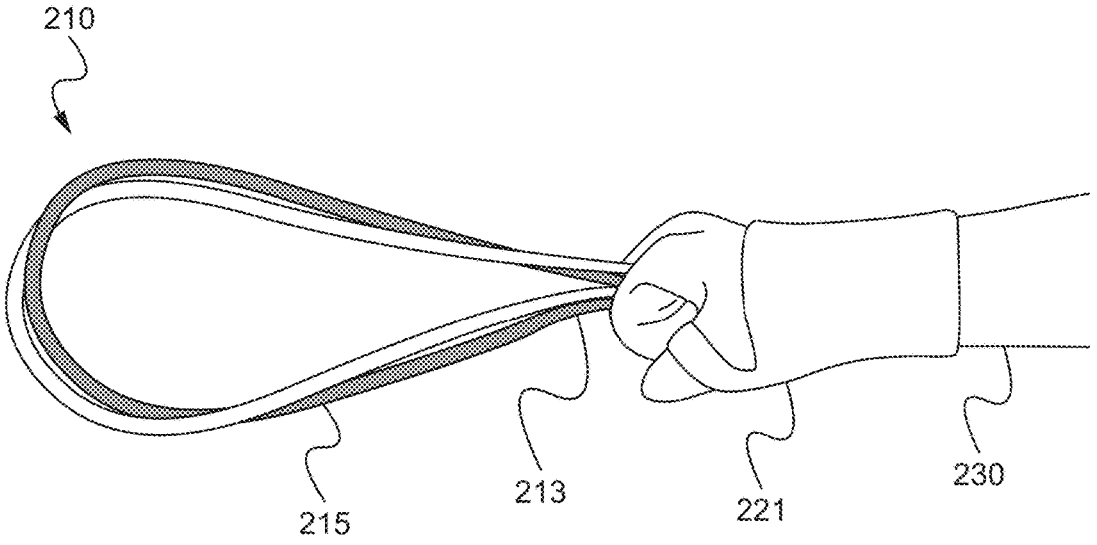
FIG. 2 illustrates a baseball training device in accordance with some embodiments.

FIG. 2 illustrates a baseball training system such as described above. As shown within FIG. 2, the hand support 221 has been wrapped around a user's wrist and thumb, such as described above. Alternatively, the hand support 221 is able to wrap around the user's hand. The grasping segment 217 or the stem is placed between the fingers of the user's hand 230 such that the plurality of flexible tubes 210 and the flexible loop 215 are in front of the user's hand. In this manner, the user is able to perform the pitching motion with the intention of hitting a target in front of the pitcher's landing foot. Particularly, as the user practices the pitching motion, the flexible loop 215 is able to hit the target in front of the pitcher's landing foot.

As described above, one or more flexible tubes 210 are arranged to form the loop 215. In some embodiments, the grasping segment 217 or the stem is held in the hand of a user when the user practices the baseball pitching motion. Particularly, in some embodiments, the grasping segment 217 or the stem is able to be held between an index finger and a middle finger of the user when the user practices the baseball pitching motion. In some embodiments, the hand support 221 is configured to reflect the approximate size and weight of a baseball.

Figure 3:
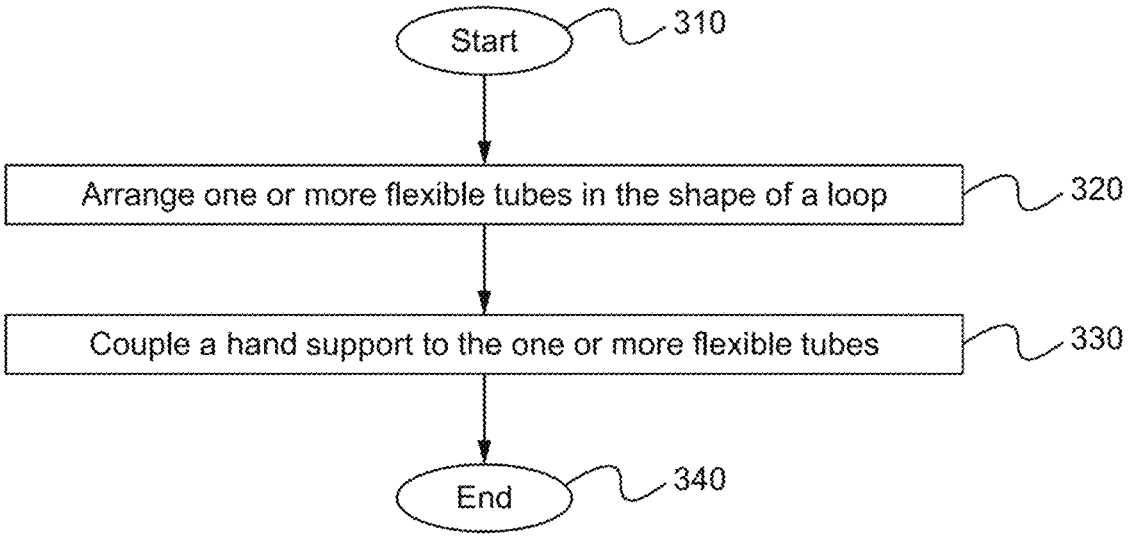
FIG. 3 illustrates a method of manufacturing a baseball training device in accordance with some embodiments.

FIG. 3 illustrates a method of manufacturing a baseball training device, such as described above. The method begins in the step 310. In the step 320, one or more flexible tubes are arranged into the shape of a loop. In some embodiments, a plurality of flexible tubes are intertwined with each other to form the flexible loop. The one or more flexible tubes comprise a first end and a second end and the one or more flexible tubes are arranged such that the first end and the second end are aligned and form a grasping segment or a stem. Then, in the step 230, a hand support is coupled with the one or more flexible tubes. In some embodiments, the hand support is removably coupled to the one or more tubes. Alternatively, in some embodiments, the hand support is non-removably coupled to the one or more tubes. When the hand support is coupled to the one or more tubes, a user is able practice the baseball pitching motion. In some embodiments, the hand support is configured to reflect the approximate size and weight of a baseball. The method ends in the step 340.

Figure 4:
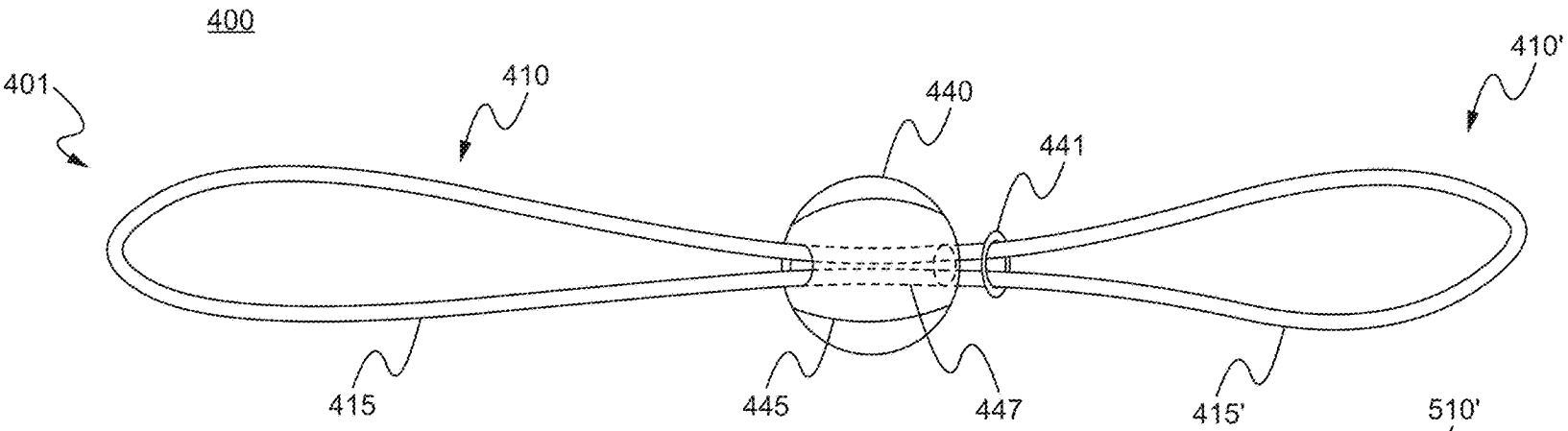
FIG. 4 illustrates a baseball training device in accordance with some embodiments.

Referring now to FIG. 4, a baseball training device in accordance with further embodiments is shown therein. The baseball training device 400 comprises a large loop 401 comprising a flexible material such as one or more flexible tubes, as described above. Alternatively, in some embodiments, the large loop 401 is able to comprise a rope or other flexible material such as appropriately desired. The large loop 401 comprising the flexible material is passed through an aperture 445 of a spherical object 440 such that a first contact segment 410 forming a first loop 415 is formed on a first side of the spherical object 440 and a second segment 410 comprising a second loop 410' is formed on a second side of the spherical object 440. As shown within FIG. 4, the first segment 410 and the second segment 410' are joined at a loop interior section 447 within the object 440. The second loop 415' is configured to adjustably fit around a wrist of a user while the spherical object 440 is grasped when the device 400 is used to simulate the baseball pitching motion such as described above.

The first segment 410 and the second segment 410' are pulled through the aperture 445 of the spherical object 440 to adjust the second loop 415' to the wrist size of the user. For example, as shown by the arrow in FIG. 4, to make the size of the second loop 415' smaller, the first segment 410 is pulled to the left which pulls the loop 401 through the interior section 447 until the second loop 415' fits securely around the wrist of the user. As the first segment 410 is pulled to the left, the first loop 415 becomes correspondingly larger. To make the size of the second loop 415' larger to fit a bigger wrist or to remove the loop 415' from the user's wrist, the second segment 410' is pulled to the right which pulls the loop 410 through the interior section 447 until the second loop 415' can be removed from the user's wrist and/or fit a bigger wrist. As the second segment 410' is pulled to the right, the first loop 415 becomes correspondingly smaller. In some embodiments, the device 400 comprises a stop 441 which prevents the loop 401 from being pulled entirely through the interior section 447 of the spherical object 440 and keeps the loop 401 from being removed.

In some embodiments, the spherical object 440 comprises the size and shape of a baseball. However, the spherical object 400 is able to comprise any appropriately desired size and shape to practice the pitching motion. To utilize the device 400, the second loop 415' is placed around and sized to a user's wrist. The user grasps the spherical object 440 and places the first segment 410 between the fingers of the user's hand such that first loop 415 is in front of the user's hand, as described above. In this position, the user is able to perform the pitching motion with the intention of hitting a target in front of the pitcher's landing foot. Particularly, as the user practices the pitching motion, the first loop 415 is able to hit the target in front of the pitcher's landing foot.

Figure 5:
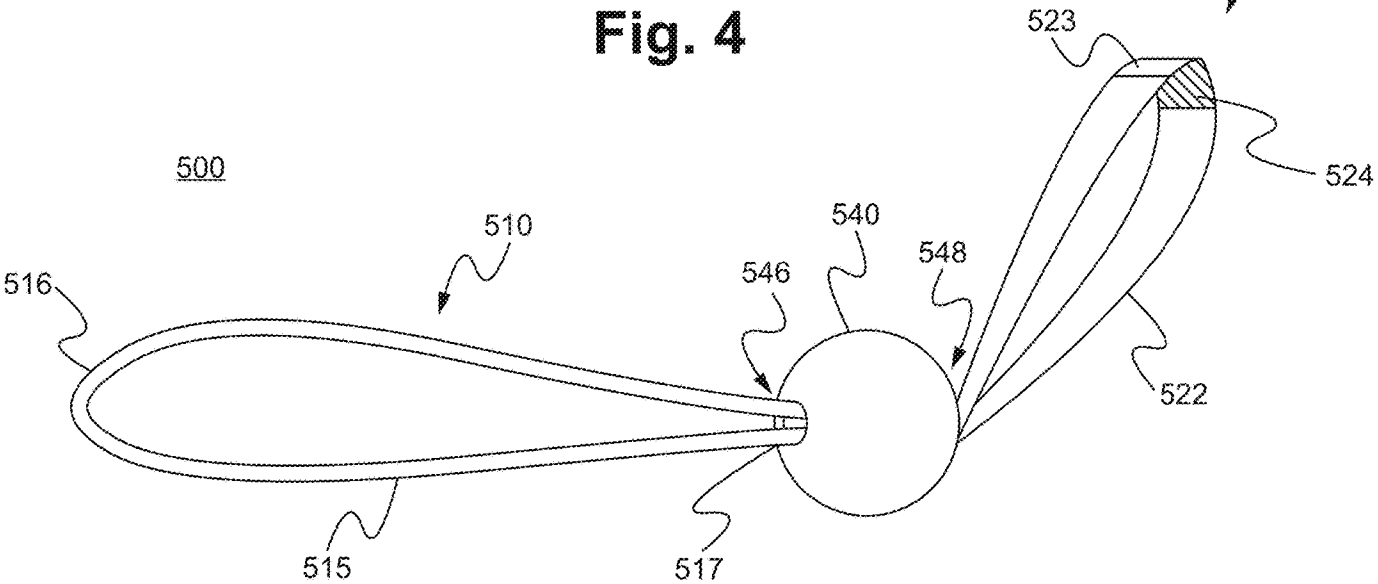
FIG. 5 illustrates a baseball training device in accordance with some embodiments.

FIG. 5 illustrates a baseball training device in accordance with yet further embodiments. The baseball training device 500 comprises a first segment 510 forming a first loop 515, a second segment 510' for adjustably fitting around a user's wrist and a spherical object 540 between the first segment 510 and the second segment 510'. As shown within FIG. 5, the first segment 510 comprises a first round end 516 and a second joined end 517. The first segment 510 couples to a first side 546 of the spherical object 540 at the second joined end 517 and the segment 510' couples to a second side 548 opposite the first side 546 of the spherical object 540.

The first segment 510 comprises a flexible material such as one or more flexible tubes, such as described above. Alternatively, in some embodiments, the first segment 510 is able to comprise a rope or other flexible material such as appropriately desired. As further shown within FIG. 5, the second segment 510' comprises a wrist loop 522 comprising a first side 523 and a second side 524. The first side 523 is configured to removably couple with the second side 524 to adjust a size of the wrist loop 522. For example, in some embodiments, the first side 523 and the second side 524 comprise a hook and loop fastening system for adjusting a size of the wrist loop 522. However, the first side 523 and the second side 524 are able to comprise any appropriately desired fastening material for adjustably fitting around the wrist of a user.

As described above, in some embodiments, the spherical object 540 comprises the size and shape of a baseball. However, the spherical object 500 is able to comprise any appropriately desired size and shape to practice the pitching motion. To utilize the device 500, the wrist loop 522 is placed around and sized to a user's wrist by coupling the first side 523 and the second side 524 together. The user grasps the spherical object 440 and places the first segment 510 between the fingers of the user's hand such that first loop 515 is in front of the user's hand, such as described above. In this position, the user is able to perform the pitching motion with the intention of hitting a target in front of the pitcher's landing foot. Particularly, as the user practices the pitching motion, the first loop 515 is able to hit the target in front of the pitcher's landing foot.

Figure 6:
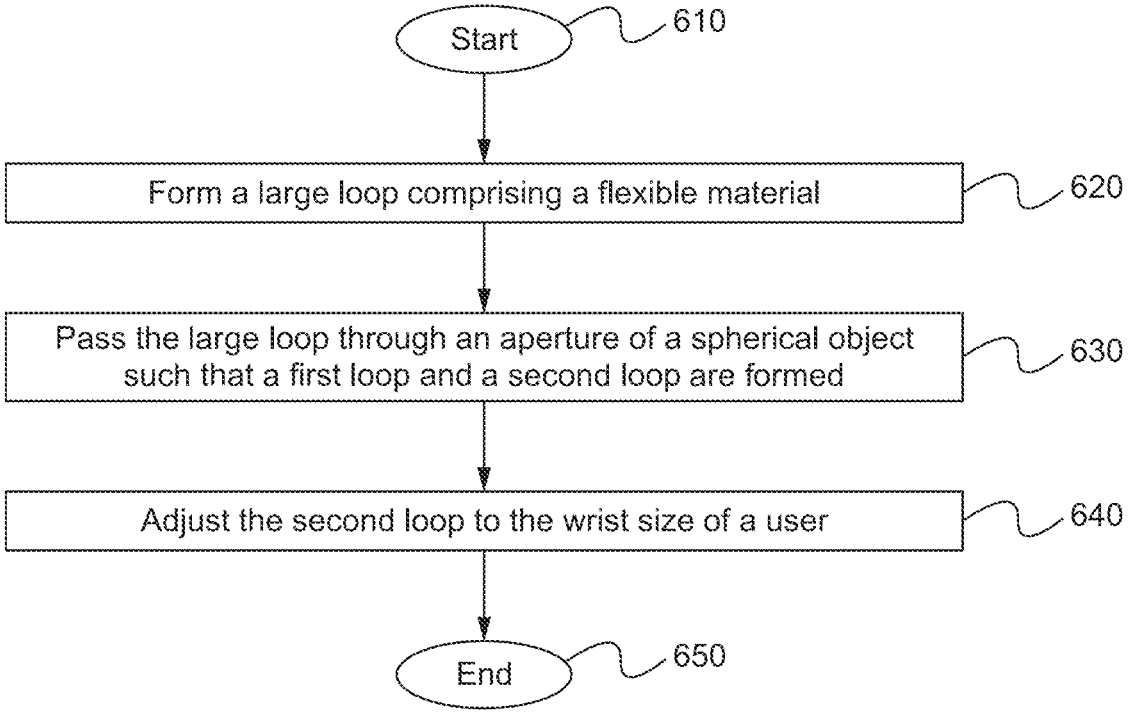
FIG. 6 illustrates a method of manufacturing a baseball training device in accordance with some embodiments.

FIG. 6 illustrates a method of manufacturing a baseball training device, such as described above. The method begins in the step 610. In the step 620, a large loop comprising a flexible material is formed. In some embodiments, the large loop comprises one or more flexible tubes, such as described above. Alternatively, in some embodiments, the large loop is able to comprise a rope or other flexible material such as appropriately desired. In the step 630, the large loop is passed through an aperture of a spherical object. The large loop is passed through the spherical object such that a first contact segment comprising a first loop and a second segment comprising a second loop for adjustably fitting around a wrist of a user are formed. As described above, in some embodiments, the spherical object comprises the size and shape of a baseball. However, the spherical object is able to comprise any appropriately desired size and shape to practice the pitching motion. Then, in the step 640, the second loop is adjusted to the wrist size of the user by pulling on one of the first loop and the second loop. With the second loop adjusted to the wrist size of the user, the baseball pitching motion is able to be practiced, such as described above. The method ends in the step 650.

Figure 7:
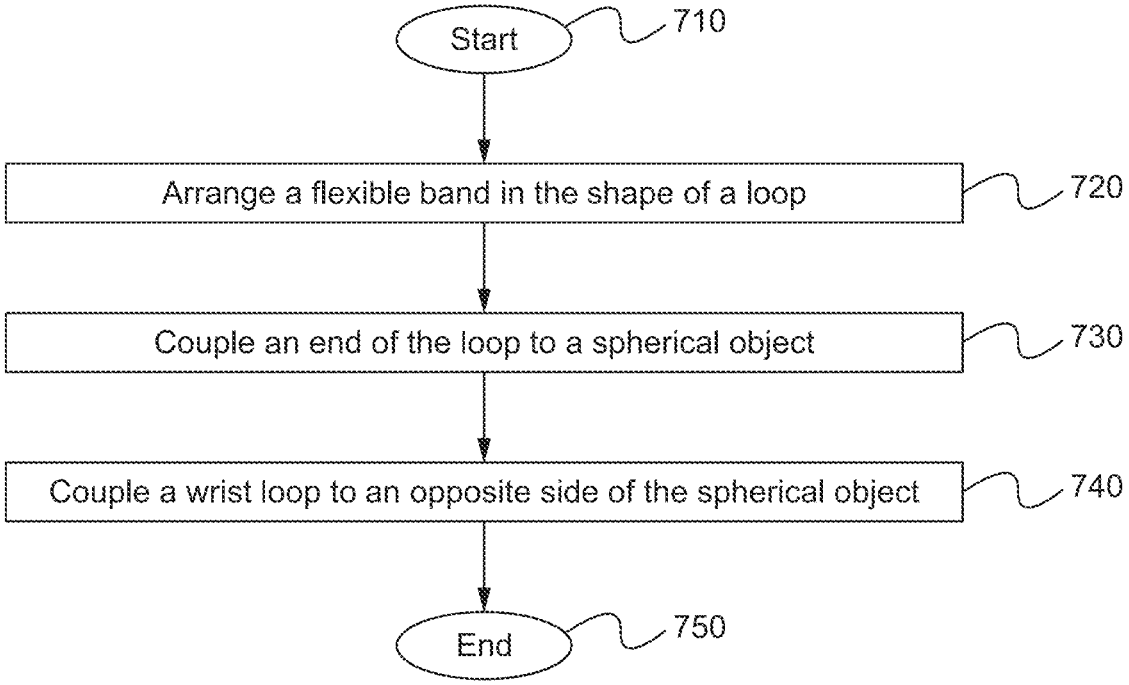
FIG. 7 illustrates a method of manufacturing a baseball training device in accordance with some embodiments.

FIG. 7 illustrates a method of manufacturing a baseball training device, such as described above in accordance with further embodiments. The method begins in the step 710. In the step 720, a flexible band is arranged in the shape of a loop. The loop is formed such that the loop forms a first round end and a second joined end. In some embodiments, the loop comprises one or more flexible tubes, such as described above. Alternatively, in some embodiments, the loop is able to comprise a rope or other flexible material such as appropriately desired. In the step 730 the second joined end is coupled to a first side of a spherical object. Then, in the step 740, an adjustable wrist support is coupled to a second side opposite the first side of the spherical object. As described above, in some embodiments, the spherical object comprises the size and shape of a baseball. However, the spherical object is able to comprise any appropriately desired size and shape to practice the pitching motion. As described above, the wrist loop comprises a first side and a second side configured to removably couple with each other to adjust a size of the wrist loop. With the wrist loop adjusted to the wrist size of the user, the baseball pitching motion is able to be practiced, such as described above. The method ends in the step 750.

Figure 8:
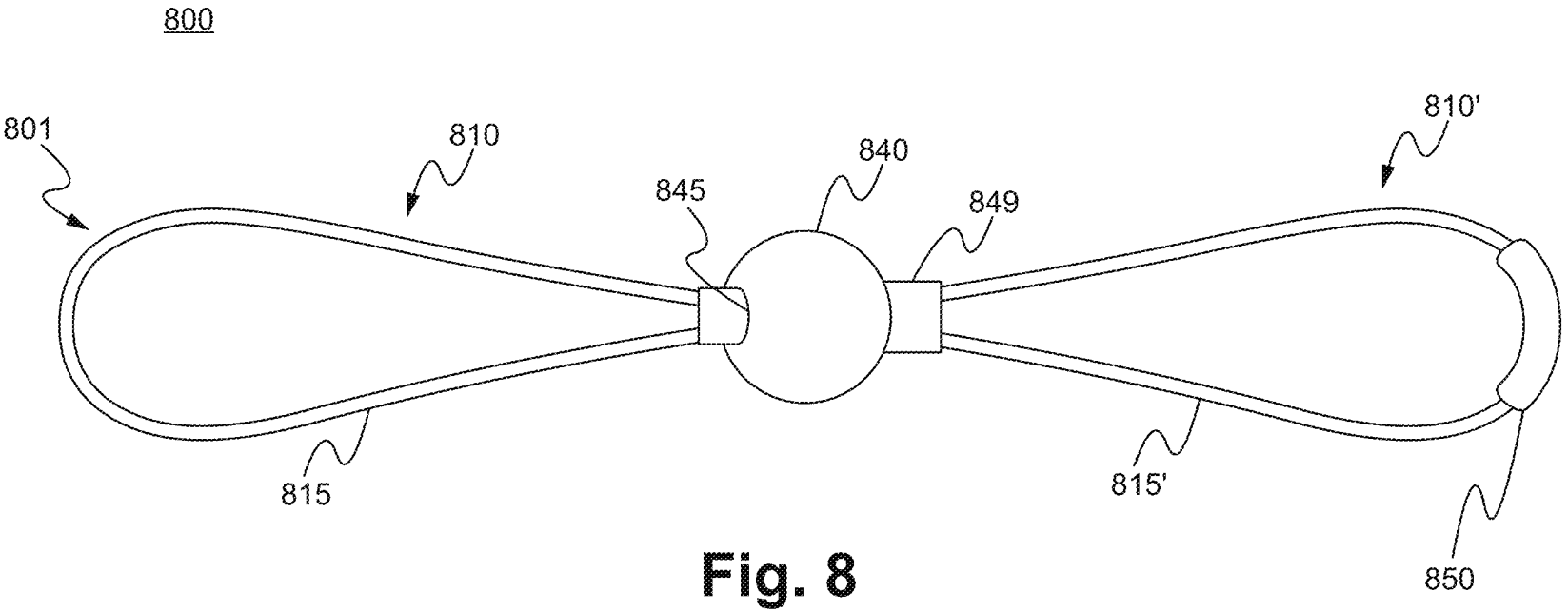
FIG. 8 illustrates a baseball training device in accordance with some embodiments.

Referring now to FIG. 8, a baseball training device in accordance with further embodiments is shown therein. The baseball training device 800 comprises a large loop 801 comprising a flexible material such as one or more flexible tubes, as described above. Alternatively, in some embodiments, the large loop 801 is able to comprise a rope or other flexible material such as appropriately desired. The large loop 801 comprising the flexible material is passed through an aperture 885 of a spherical object 840 such that a first contact segment 810 forming a first or whip loop 815 is formed on a first side of the spherical object 840 and a second segment 810 comprising a second or handle loop 815' is formed on a second side of the spherical object 840. As shown within FIG. 8, the whip loop 815 and the handle loop 815' are joined at a loop interior section 845 within the object 840. In some embodiments, a tubing sleeve 849 passes through the interior section 845 of the object 840. The tubing sleeve 849 is able to act as a bearing surface for the object 840 and the flexible material of the large loop 801. In some embodiments, the handle loop 815' is configured to adjustably fit around a wrist of a user while the spherical object 840 is grasped when the device 800 is used to simulate the baseball pitching motion such as described above.

In some embodiments, the spherical object 840 comprises a diameter of 2.75". However, the spherical object 840 is able to comprise any appropriately desired size. In some embodiments, such as shown within FIG. 8, the baseball training device 800 comprises a joiner 850 that wraps around two ends of the large loop 801 to join the two ends and form the large loop 801. However, the two ends of the loop 801 are able to be joined by any appropriately desired method. For example, in some embodiments the two ends of the loop 801 are fused and/or glued together.

The first segment 810 and the second segment 810' are pulled through the aperture 885 of the spherical object 840 to adjust the handle loop 815' to the wrist size of the user. For example, as shown by the arrow in FIG. 8, to make the size of the handle loop 815' smaller, the first segment 810 is pulled to the left which pulls the loop 801 through the interior section 887 until the second loop 815' fits securely around the wrist of the user. As the first segment 810 is pulled to the left, the whip loop 815 becomes correspondingly larger. To make the size of the second loop 815' larger to fit a bigger wrist or to remove the handle loop 815' from the user's wrist, the second segment 810' is pulled to the right which pulls the loop 810 through the interior section 887 until the handle loop 815' can be removed from the user's wrist and/or fit a bigger wrist. As the second segment 810' is pulled to the right, the whip loop 815 becomes correspondingly smaller.

In some embodiments, the spherical object 840 comprises the size and shape of a baseball. However, the spherical object 800 is able to comprise any appropriately desired size and shape to practice the pitching motion. To utilize the device 800, the handle loop 815' is placed around and sized to a user's wrist. The user grasps the spherical object 840 and places the first segment 810 between the fingers of the user's hand such that whip loop 815 is in front of the user's hand, as described above. In this position, the user is able to perform the pitching motion with the intention of hitting a target in front of the pitcher's landing foot. Particularly, as the user practices the pitching motion, the whip loop 815 is able to hit the target in front of the pitcher's landing foot.

In some embodiments, the baseball training device, such as described above, is a lightweight training device and is manufactured from one or more of plastic, rubber, foam, and/or is made from other lightweight materials. Particularly, the baseball training device, such as described above, is able to comprise any appropriately desired materials and combination of materials. Additionally, in some embodiments, the baseball training device, such as described above, is designed to provide low resistance, minimal resistance, and/or no resistance depending on the application. However, the baseball training device, such as described above, is also able to be configured to provide any appropriately desired amount of resistance. In some embodiments, the amount of resistance provided by the baseball training device is adjustable.

In operation, the baseball training device, as described above, is able to be used to mimic the towel drill. The device comprises a contact segment in the shape of a flexible loop coupled to a first side of an object and a securing mechanism coupled to a second side of the object. The flexible loop is intended to hit a target in front of the pitcher's landing foot. Because the one or more tubes are flexible, they move and extend during the pitching motion without adding stress to the arm of the user. Particularly, as the user goes through the pitching motion, the loop extends out to the target to provide feedback to the user. This enables the user to practice maintaining good posture and balance. This additionally enables the pitcher to work on stride length and separation of hips and shoulders.

Particularly, the baseball training device, as described above is a training tool for baseball pitchers and other individuals that throw a baseball. The training purpose increases the pitcher's arm and snap speed so that the ball will move and spin faster. In addition, the device is also able to be used in physical therapy for recover of arm strength and improve the throwing form and mechanics. A user is able to fit a hand within a main loop and grasp the ball. The user is then able to perform throwing and pitching movements with the final move being a snap to engage the whip sound and action of the device. As such, the baseball training device as depicted herein has many advantages.

The present invention has been described in terms of specific embodiments incorporating details to facilitate the understanding of the principles of construction and operation of the invention. Such references, herein, to specific embodiments and details thereof are not intended to limit the scope of the claims appended hereto. It will be apparent to those skilled in the art that modifications can be made in the embodiments chosen for illustration without departing from the spirit and scope of the invention.

What is claimed is:

1. A baseball training device comprising:

a. a large loop comprising:

i. a first contact segment comprising a first loop; and ii. a second segment comprising a second loop for adjustably fitting around a wrist of a user;

b. a spherical object configured to be grasped by a user coupled to the device between the first segment and the second segment, wherein the large loop is passed through an aperture of the spherical object to form the first segment and the second segment, and further wherein the first segment and the second segment are pulled through the aperture of the object to adjust a size of the second loop to the wrist of the user;

c. a joiner that wraps around a first end and a second end of the large loop to join the first end and the second end and form the large loop; and d. a tubing sleeve comprising a first opening and a second opening that fits between the large loop and the spherical object and passes through the spherical object, wherein the large loop fits inside the tubing sleeve and the first loop extends through the first opening and the second loop extends through the second opening and further wherein the first sleeve opening and the second sleeve opening are both positioned outside the spherical object.

2. The baseball training device of claim 1, wherein the spherical object Comprises a diameter of 2.75".

3. The baseball training device of claim 1, wherein the spherical object comprises the size and shape of a baseball.

4. The baseball training device of claim 1, wherein the baseball training system is used to practice a pitching motion.

5. A baseball training device comprising:

a. a large loop comprising:

i. a first contact segment comprising a first flexible loop;

ii. a second segment for adjustably fitting around a wrist of a user;

b. a spherical object configured to be grasped by a user coupled between the first segment and the second segment, wherein the large loop is passed through an aperture of the spherical object to form the first segment and the second segment, and further wherein the second segment is adjustable to fit around a wrist of a user;

c. a joiner that wraps around a first end and a second end of the large loop to join the first end and the second end and form the large loop, and wherein the spherical object is grasped while the baseball training system is used to simulate the baseball pitching motion; and d. a tubing sleeve comprising a first opening and a second opening that fits between the large loop and the spherical object and passes through the spherical object, wherein the large loop fits inside the tubing sleeve and the first contact segment extends through the first opening and the second segment extends through the second opening and further wherein the first sleeve opening and the second sleeve opening are both positioned outside the spherical object.

6. The baseball training device of claim 5, wherein the spherical object comprises a diameter of 2.75".

7. The baseball training device of claim 5, wherein the first segment and the second segment are pulled through an aperture of the object to adjust a size of the second segment to the wrist of the user.

8. The baseball training device of claim 5, wherein the second segment comprises a hook and loop material for adjusting a size of the second segment to the wrist of the user.

9. The baseball training device of claim 5, wherein the spherical object comprises the size and shape of a baseball.

10. The baseball training device of claim 5, wherein the baseball training system is used to practice a pitching motion.

11. A baseball training device comprising:

a. a large loop comprising one of a rope and a flexible material, the large loop comprising:

i. a first contact segment comprising a first loop; and ii. a second segment comprising a second loop for adjustably fitting around a wrist of a user;

b. a spherical object comprising the size and shape of a baseball and configured to be grasped by a user coupled to the device between the first segment and the second segment, wherein the large loop is passed through an aperture of the spherical object to form the first segment and the second segment, and further wherein the first segment and the second segment are pulled through the aperture of the object to adjust a size of the second loop to the wrist of the user; and c. a tubing sleeve comprising a first opening and a second opening that fits between the large loop and the spherical object and passes through the spherical object, wherein the large loop fits inside the tubing sleeve and the first contact segment extends through the first sleeve opening and the second segment extends through the second sleeve opening and further wherein the first opening and the second opening are both positioned outside the spherical object.

* * * * *